US007058325B2

(12) United States Patent
Hamby et al.

(10) Patent No.: US 7,058,325 B2
(45) Date of Patent: Jun. 6, 2006

(54) SYSTEMS AND METHODS FOR CORRECTING BANDING DEFECTS USING FEEDBACK AND/OR FEEDFORWARD CONTROL

(75) Inventors: Eric S. Hamby, Fairport, NY (US); Eric M. Gross, Rochester, NY (US); Daniel E. Viassolo, Schenectady, NY (US); Michael D. Thompson, Rochester, NY (US); R. Enrique Viturro, Rochester, NY (US); Fei Xiao, Penfield, NY (US); Clark V. Lange, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 31 days.

(21) Appl. No.: 10/852,216

(22) Filed: May 25, 2004

(65) Prior Publication Data

US 2005/0265740 A1 Dec. 1, 2005

(51) Int. Cl.
*G03G 15/00* (2006.01)

(52) U.S. Cl. ..... 399/49; 399/60

(58) Field of Classification Search ..... 399/46, 399/49, 53, 60

See application file for complete search history.

(56) References Cited

U.S. PATENT DOCUMENTS

| | | | |
|---|---|---|---|
| 3,948,217 | A | 4/1976 | Forward |
| 3,953,121 | A | 4/1976 | Reichart, Jr. |
| 3,998,537 | A | 12/1976 | Smith et al. |
| 4,105,345 | A | 8/1978 | Van Wagner |
| 4,117,803 | A | 10/1978 | Kito |
| 4,218,125 | A | 8/1980 | Silversberg |
| 4,499,851 | A | 2/1985 | Kopko et al. |
| 4,561,763 | A | 12/1985 | Basch |
| 5,155,530 | A | 10/1992 | Larson et al. |
| 5,887,223 | A | 3/1999 | Sakai et al. |
| 6,456,808 | B1 | 9/2002 | Chen et al. |
| 6,909,858 | B1 * | 6/2005 | Hama et al. ..... 399/49 |
| 2003/0142985 | A1 | 7/2003 | Sampath et al. |

FOREIGN PATENT DOCUMENTS

EP 1 197 916 A2 4/2002

OTHER PUBLICATIONS

Lin, G.Y. et al. "Banding Artifact Reduction in Electrophotographic Printers Using Pulse Width Modulation." *IEEE Transactions on Image Processing.*

Ewe, M. "Banding Reduction in Electrophotographic Processes Using Piezoelectric Actuated Laser Beam Deflection Device." *Journal of Imaging Science and Technology.*

* cited by examiner

*Primary Examiner*—Hoang Ngo
(74) *Attorney, Agent, or Firm*—Oliff & Berridge, PLC

(57) ABSTRACT

Systems and methods of controlling banding defects on a receiving member in an imaging or printing process using a feedback and/or feedforward control technique. In one exemplary embodiment, a method of controlling banding defects on a receiving member in an imaging or printing process includes (a) determining a toner density on the receiving member, (b) automatically determining the extent of banding on the receiving member by comparing the determined toner density to a reference toner density value, and (c) automatically adjusting the toner density based on a result obtained from the comparison of the measured toner density to the reference toner density value, automatically determining the extent of banding and automatically adjusting the toner density being performed using a feedback and/or feedforward control routine or application.

29 Claims, 10 Drawing Sheets

PROCESS

PROCESS

SYSTEMS AND METHODS FOR CORRECTING BANDING DEFECTS USING FEEDBACK AND/OR FEEDFORWARD CONTROL

BACKGROUND OF THE INVENTION

1. Field of Invention

This invention relates to systems and methods for detecting and correcting image quality defects, such as banding defects, in image marking devices, such as, for example, xerographic marking devices, using feedback and/or feedforward control.

2. Description of Related Art

A common image quality defect introduced by the copying or printing process is banding. Banding generally refers to periodic, linear structures on an image caused by a one-dimensional density variation in either the cross-process (fast scan) direction or process (slow scan) direction. FIG. 1 shows an image taken from an image marking device, such as, for example, a xerographic printer that illustrates an extreme case of banding due to photoreceptor and magnetic roll runout. A typical density variation of this image in the process direction is shown in FIG. 2.

Banding defects can result due to many xerographic subsystem defects such as, for example, development nip gap variation caused by developer roll runout and/or photoreceptor drum runout, coating variations on either the developer rolls or the photoreceptor, non-uniform photoreceptor wear and/or charging, and developer material variations.

One approach to mitigate banding defects is by specifying tight tolerances in subsystem design. One problem with this "passive" approach is that stringent image quality specifications increasingly lead to subsystem components with tighter and tighter tolerances, which, in turn, are more costly to manufacture. Another potential problem is scalability. That is, the subsystem design for one product in a family may not be appropriate for a different product in the same family, thus leading to costly and time consuming redesign. Furthermore, specifying tight tolerances in subsystem design has limited robustness properties. For example, using developer rolls with a tight tolerance on runout will not help with banding due to photoreceptor wear.

SUMMARY OF THE INVENTION

Given the above discussed limitations of current "passive" approaches to correct banding, it is desirable to employ an "active" approach to mitigate banding defects.

This invention provides systems and methods that control image quality defects, such as banding defects, in xerographic image marking devices using feedback and/or feedforward control.

This invention further provides systems and methods that can actively detect and correct image quality defects, such as banding defects, in xerographic image marking devices using closed-loop feedback and/or feedforward control techniques.

In various exemplary embodiments of the systems and methods according to this invention, banding defects are determined and corrected using a feedback and/or feedforward control approach.

In various exemplary embodiments of the systems and methods according to this invention, banding defect is controlled by determining a one-dimensional density variation in an image using an optical sensor, and reducing or eliminating the one-dimensional density variation using one or more subsystem actuators in accordance with a feedback and/or feedforward control routine or application.

In various exemplary embodiments of the systems and methods according to this invention, using a closed-loop feedback and/or feedforward control approach enables the use of components with relaxed tolerances, which would reduce unit machine cost (UMC). Furthermore, using a feedback and/or feedforward control approach would allow controller design to be easily scaled from one product to the next. Moreover, feedback and/or feedforward control is inherently robust to subsystem variations, such as developer material variations and roll runout.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the systems and methods of this invention will be described in detail, with reference to the following figures, wherein.

DETAILED DESCRIPTION OF PREFERRED EMBODIMENTS

These and other features and advantages of this invention are described in, or are apparent from, the following detailed description of various exemplary embodiments of the systems and methods according to this invention.

Figure 3:
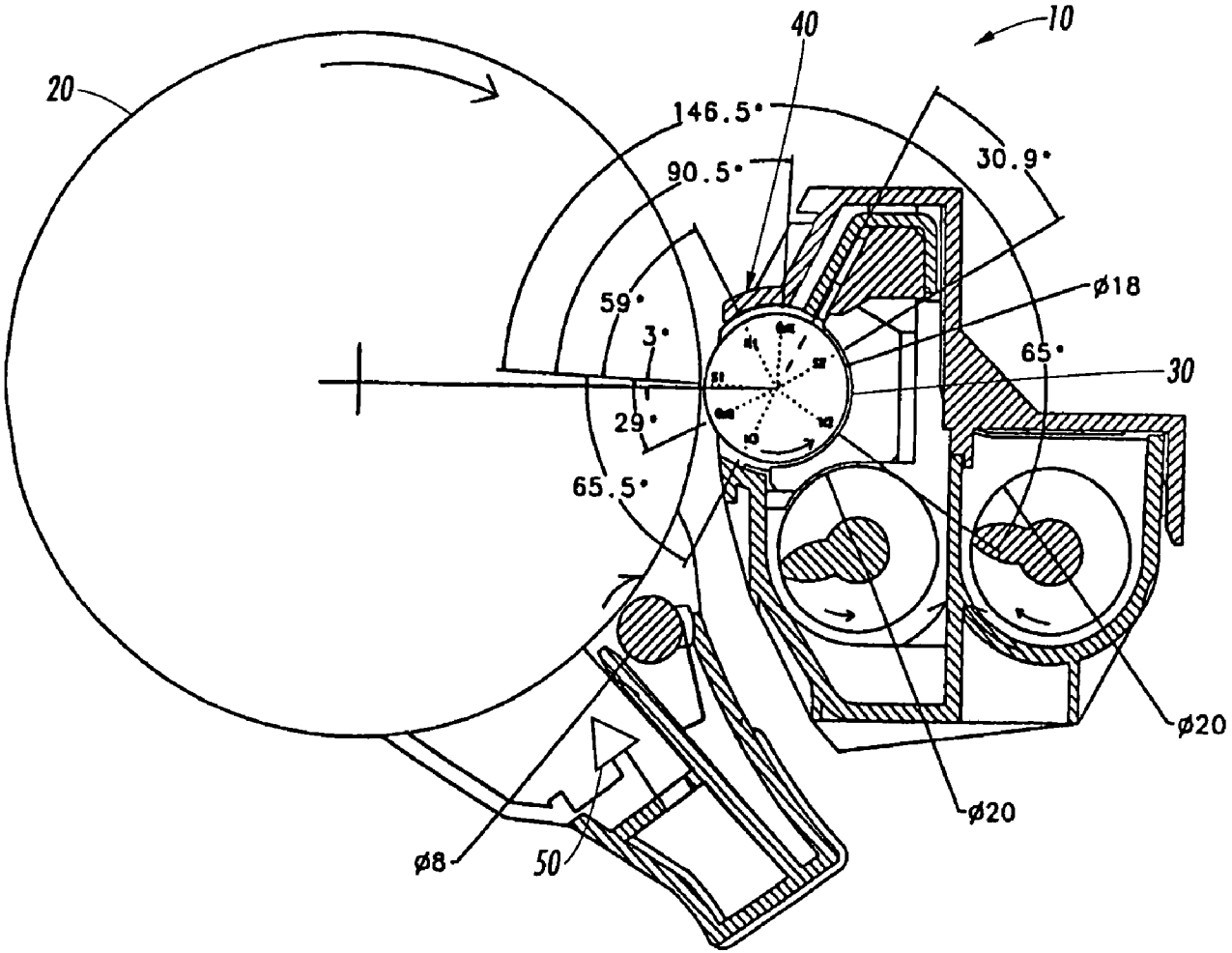
FIG. 3 schematically illustrates an exemplary image marking device developer housing and sensors that can be used to implement a feedback and/or feedforward loop control architecture for controlling banding defects in an image.

FIG. 3 schematically illustrates an exemplary image marking device developer housing 10, such as an electrophotographic (EP) device developer housing, and one or more optical sensors 50 that can be used to implement a feedback and/or feedforward loop control architecture for controlling banding defects in an image. As shown in FIG. 3, typical EP devices, such as photocopiers, scanners, laser printers and the like, may include a photoreceptor drum 20, which may be an organic photoconductive (OPC) drum 20, that rotates at a constant angular velocity. The EP device shown in FIG. 3 further includes a magnetic roll 30 and a trim bar 40.

As the OPC drum 20 rotates, it is electrostatically charged, and a latent image is exposed line by line onto the OPC drum 20 using a scanning laser or an light emitting diode (LED) imager. The latent image is then developed by electrostatically adhering toner particles to the photoreceptor 20, e.g. OPC drum 20. The developed image is then transferred from the OPC drum 20 to the output media, e.g., paper. The toner image on the paper is then fused to the paper to make the image on the paper permanent.

According to various exemplary embodiments of this invention, closed loop feedback and/or feedforward controlled architectures or strategies are disclosed that can be used to determine, control and mitigate banding defects discussed above. Mitigating banding defects is done, according to various exemplary embodiments, by first determining the banding defects in the developed image on the receiving member using one or more optical sensors, then altering the image marking process parameters, e.g., printing parameters, to eliminate the defects.

Continuing with reference to FIG. 3, in various exemplary embodiments, the receiving member can be the photoreceptor 20, the intermediate belt or the sheet of paper. The optical sensors 50 used to determine the banding defects may include, according to various exemplary embodiments, enhanced toner area coverage (ETAC) sensors or other single spot (or point) sensors. According to various alternative exemplary embodiments, the sensors 50 are array-type sensors such as, for example, full-width array (FWA) sensors, and the like.

According to various exemplary embodiments, the sensors 50 actuate an electromechanical actuator such as, for example, a developer roll voltage $V_{dev}(t)$, where t is time, using a feedback and/or feedforward control loop. The developer roll voltage $V_{dev}$, according to various exemplary embodiments, is used as an actuator to remove the mean banding level.

Figure 1:
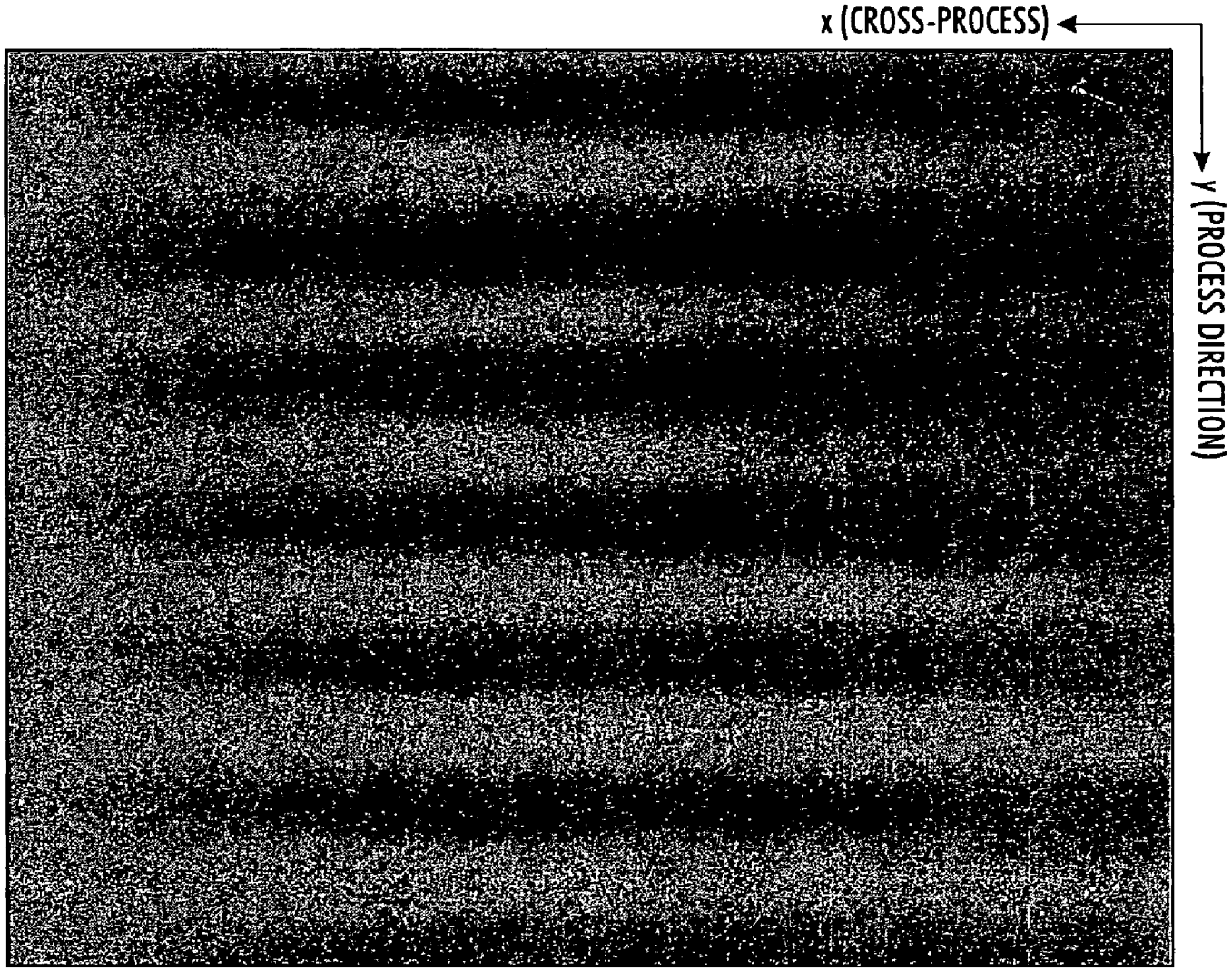
FIG. 1 shows an example of a banding defect due to photoreceptor and magnetic roll runout.

As discussed above, in typical developer housings, the developer roll voltage ($V_{dev}$) can be adjusted as a function of time, that is, in the process direction. Accordingly, the developer roll voltage $V_{dev}$ can control uniform banding by removing some amount of banding along the process direction. For example, ($V_{dev}$) can lighten the dark lines shown on FIG. 1. In this approach, the developer roll voltage $V_{dev}$ may be used as a one-dimensional actuator.

Calibration could occur during machine cycle-up and involves developing a given patch structure, sensing the banding defect on the photoreceptor using an optical sensor (e.g. ETAC), and actuating the development field using a feedback and/or feedforward control strategy, such as for example, repetitive control or adaptive feedforward control strategies. After a uniform density in the developed image is achieved, the resulting periodic control signal is stored as a function of developer roll position using, for example, an encoder. During routine machine operation, controlling and/or mitigating banding defects can be achieved by "playing back" the calibrated development field according to the developer roll position.

As a particular example, the following discussion considers banding due to developer roll runout. However, the feedback and/or feedforward control calibration strategies described herein are useful and applicable to address banding due to other sources as well. By implementing this invention, both UMC reduction and higher print quality are achieved.

The exemplary feedback and/or feedforward control strategies or architectures presented herein may be used to mitigate banding defects from any number of sources. However, for illustrative purposes, the feedback and/or feedforward control strategies discussed below will generally focus on controlling banding defects due to developer roll runout along the roll axis.

Figure 2:
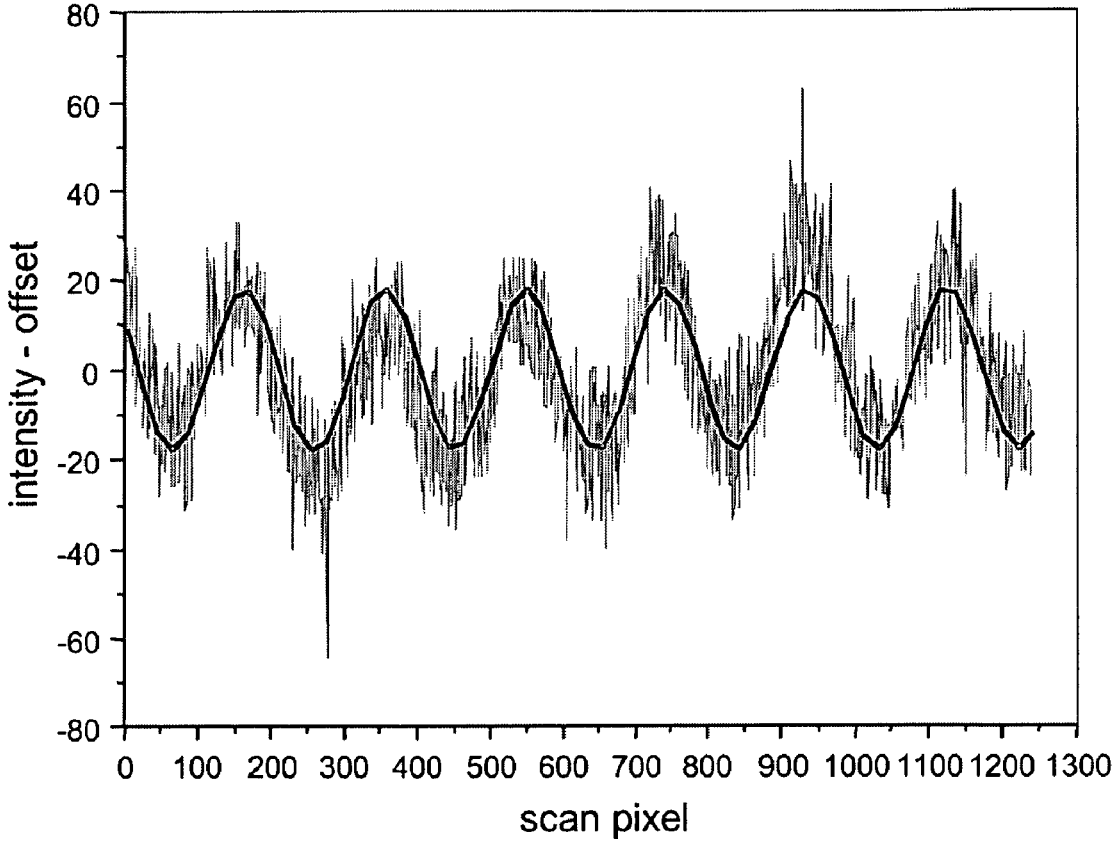
FIG. 2 illustrates a typical density variation in the process direction in uniform banding.

The methods and systems according to various exemplary embodiments of this invention are used to achieve a spatially uniform developed image on the photoreceptor despite the periodic disturbance due to runout shown in FIG. 2. This disturbance has a known spatial period, which is computed as follows:

$$T_d = \frac{2\pi\rho_{MR}}{SR}, \tag{1}$$

where $T_d$ is the spatial period of the runout disturbance as projected onto the photoreceptor, $\rho_{MR}$ is the radius of the magnetic roll and SR is the speed ratio of the magnetic roll to the photoreceptor.

In various exemplary embodiments, the systems and methods according to this inventions employ various approaches or techniques for rejecting sinusoidal disturbances of a known period. One exemplary approach or technique is based on the Internal Model Principle. Generally, the Internal Model (IM) principle states that the feedback loop must contain a model of the disturbance to cancel the effect of the disturbance on the system output.

Another exemplary approach or technique is referred to as adaptive feedforward control (AFC) technique. The AFC technique adaptively constructs a model of the disturbance, which is then "fed forward" and injected into the system to cancel the effect of the periodic disturbance. The control architectures for rejecting banding disturbances based on these two approaches are discussed in more detail below.

It will be noted that the systems and methods of this invention are not limited to the two approaches or techniques discussed above. One skilled in the art of feedback and/or feedforward control methods may employ other known or to be developed techniques or approaches to model and mitigate banding defects.

Figure 4:
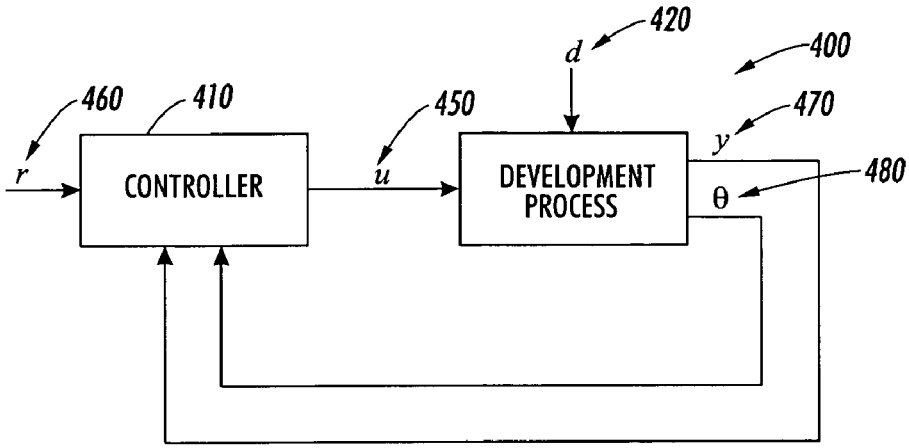
FIG. 4 illustrates an exemplary embodiment of a feedback and/or feedforward loop control architecture for controlling banding defects in an image.

An exemplary embodiment of a closed loop feedback and/or feedforward control structure/architecture 400 is shown in FIG. 4. As shown in FIG. 4, r (460) is the target value for the developed mass average (DMA) of a reference patch (or patches) on the photoreceptor, u (450) is the magnetic roll voltage $V_{dev}$ as computed by the controller (410), y (470) is the measured DMA as determined from an optical sensor 50, e.g. ETAC sensor (shown in FIG. 3), θ (480) is the angular position of the magnetic roll (shown as 30 in FIG. 3), which may be provided and or stored as an encoder reading, and d (420) represents the banding disturbances impacting the system 100 (shown in FIG. 3).

The controller 410 in this set-up is assumed to contain a built-in model of the disturbance according to the Internal Model Principle. Repetitive control falls under this category and is known to be an effective means for rejecting disturbances of a known period such as the banding disturbance of interest here. An exemplary repetitive control law is provided in the following equation:

$$u(z) = \frac{z^{-N}}{1 - f(z^{-1})z^{-N}}(r - y(z)), \tag{2}$$

where z is the z-transform variable, N is the period length of the disturbance, and $f(z^{-1})$ represents a filter designed to ensure that the resulting closed-loop system is stable. One important feature of a repetitive controller is that it places poles at the disturbance frequencies (the internal model of the disturbance), which enables cancellation of the periodic disturbance. This basic control structure 400 can be expanded in a number of ways to handle more complex situations. For example, multiple repetitive controllers 410 could be used to reject multiple periodic disturbances d (420).

When implementing a controller in this framework (as well as in the AFC framework described below), one potential issue that needs to be overcome is the size of the test pattern or reference patch (or patches) on the photoreceptor that would need to be measured by the optical sensor in order for the controller to "learn" the disturbance. To illustrate the point, consider an exemplary image marking device. The radius of the magnetic roll is 9 mm and the speed ratio is 1.75, which, according to Eq. (1), gives a spatial period of 32.3 mm. The circumference of the photoreceptor drum is 82.9 mm. Since measurements of multiple periods of the disturbance may be needed to "learn" the disturbance, the patch needed in this example would certainly go beyond any inter-document zone and may even require multiple revolutions of the drum depending on the number of periods measured. Consequently, this learning process could not take place during customer printing. This is generally not a problem, however, because a banding disturbance like that shown in FIG. 1 generally does not change substantially over time and, as a result, would likely require only infrequent characterization.

Assuming that the banding disturbance properties only change slowly with respect to time enables banding defect calibration. In calibration mode, the method may require printing a test pattern or reference patch of sufficient size for the controller to "learn" the periodic banding disturbance. This mode would occur during, for example, cycle-up prior to customer printing. Its purpose is to establish the baseline control voltage waveform needed to counteract the banding defects. After establishing a uniform image on the photoreceptor, the controller records the resulting development voltage as a function of developer roll position. This is the development field that will then be used during customer printing to counteract banding defects.

Figure 5:
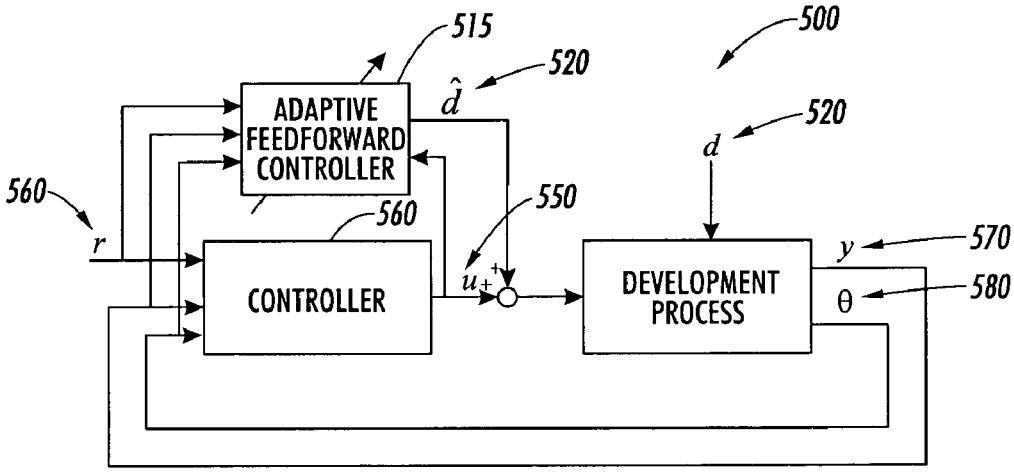
FIG. 5 illustrates another exemplary embodiment of a feedback and/or feedforward loop control architecture for controlling banding defects in an image.

FIG. 5 schematically illustrates another exemplary embodiment of a closed loop feedback and/or feedforward control architecture 500, such as an Adaptive Feedforward Control (AFC) architecture 500, that may also be used to control and/calibrate the development field. In the AFC architecture, for a DMA target value r (560) of a reference patch or test pattern, the controller 510 is designed to achieve nominal performance, which could include rejection of non-periodic disturbances, such as, for example, a proportional-integral-derivative (PID) controller 510, and the adaptive feedforward controller 515 is designed to cancel the periodic disturbance. To do this, the adaptive feedforward controller 515 adaptively constructs a model of the periodic disturbance and then adds this signal "on top" of the control signal to cancel the effect of the disturbance on the system output. The structure of the disturbance model is Fourier expansion as follows:

$$\hat{d}(i) = \sum_{j=1}^{M} \alpha_j \sin(\omega_j i), \tag{3}$$

where $\hat{d}$ (525) is the disturbance estimate, i is the discreet time index, $\omega_j = 2\pi j/N$, N is the length of the disturbance period, and the $\alpha_j$ are the model coefficients that are to be estimated from measurement data.

The error, e, is calculated using the formula $$e = r - y \tag{4}$$

where term r (560) represents the target DMA value and y (570) represents the measured DMA as determined from the optical sensor. Given a model of the development process, and the applied control signal, u (550), estimates of the disturbance model coefficients can be calculated and updated in real-time using a standard least-squares algorithm. In calibration mode, a given reference patch or test pattern would be measured to establish the estimate of the disturbance, $\hat{d}$ (520). Once the disturbance estimate converges, the control signal is stored and synchronized to developer roll position as described above. As discussed above, the angular position θ (580) of the magnetic roll (shown as 30 in FIG. 3), may be provided and or stored as an encoder reading.

Figure 6:
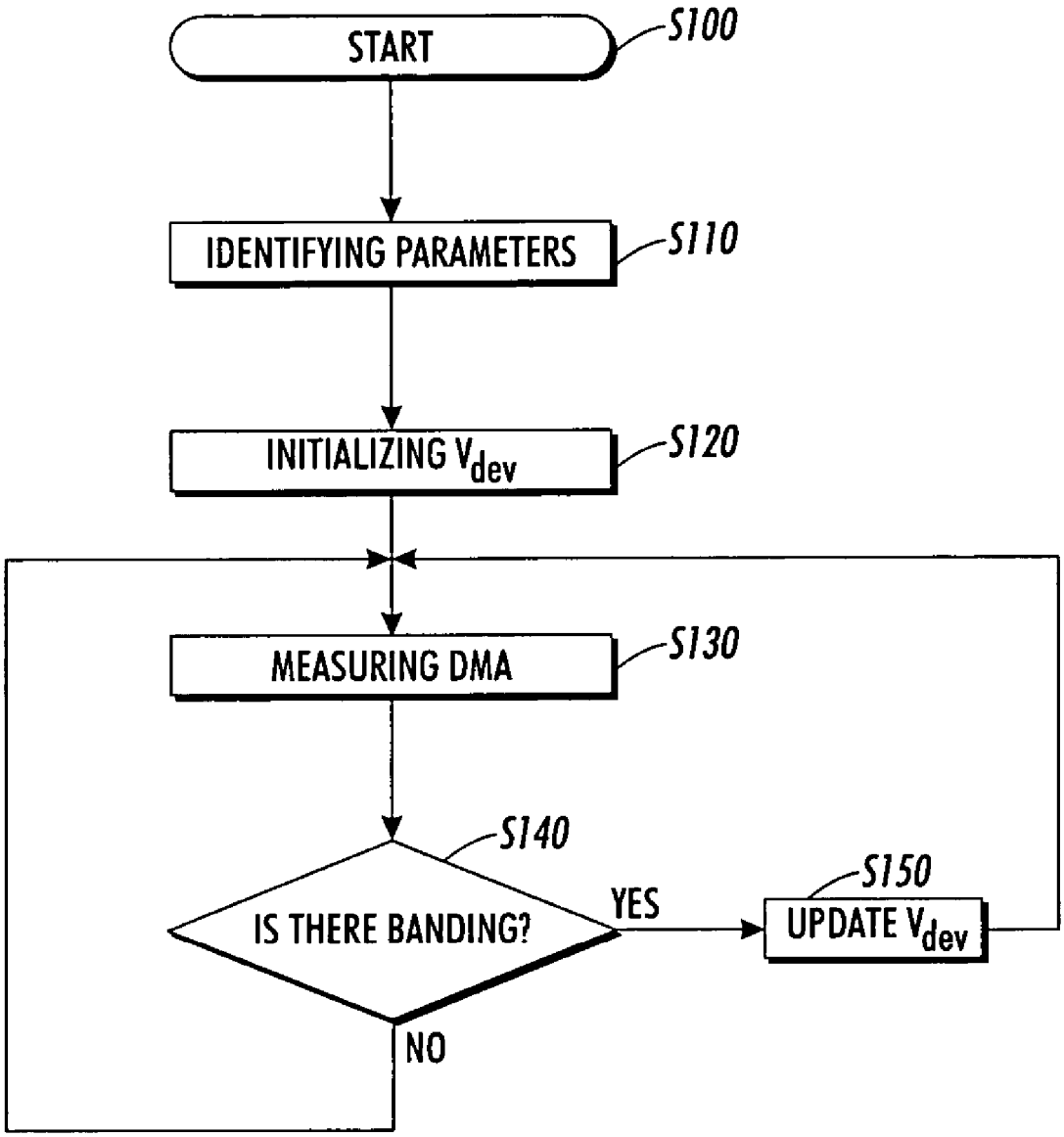
FIG. 6 is a flowchart of an exemplary embodiment of a method of establishing the parameters of the feedback and/or feedforward control loop for controlling banding defects.

FIG. 6 is a flowchart of an exemplary embodiment of a method of establishing the parameters of the feedback and/or feedforward control loop for controlling banding defects. According to various exemplary embodiments, establishing the feedback and/or feedforward control loop starts at step S100. Next, during step S110, the parameters $\alpha_j$ are identified by using a known pattern and measuring the resulting developer roll voltage ($V_{dev}$) or full-width amplitude (FWA) signal. When the test pattern is measured, a least squares fit to the resulting data may be used to provide estimates of the parameters $\alpha_j$, thus setting up equations 1–4. Next, once the parameters $\alpha_j$ are identified during step S110, control continues to step S120.

During step S120, the developer roll voltage ($V_{dev}$) is initialized and an image is produced. Next, control continues to step S130. During step S130, developer mass average (DMA) is measured at the different sensor locations. Next, control continues to step S140.

During step S140, the controller determines whether there is a large amount of banding. A large amount of banding is a variation which a typical consumer of the product, upon viewing an image of a uniform area, would notice the banding to be objectionable. If a large amount of banding is determined, then control continues to step S150. During step S150, the developer roll voltage ($V_{dev}$) is configured, i.e., updated so as to reduce the amount of banding determined. Following step S150, control goes back to step S130 in order to measure the resulting DMA at the different sensor locations.

If a large amount of banding is not determined, then control jumps back to step S140. During step S140, the controller determines again whether there is a large amount of banding.

Figure 7:
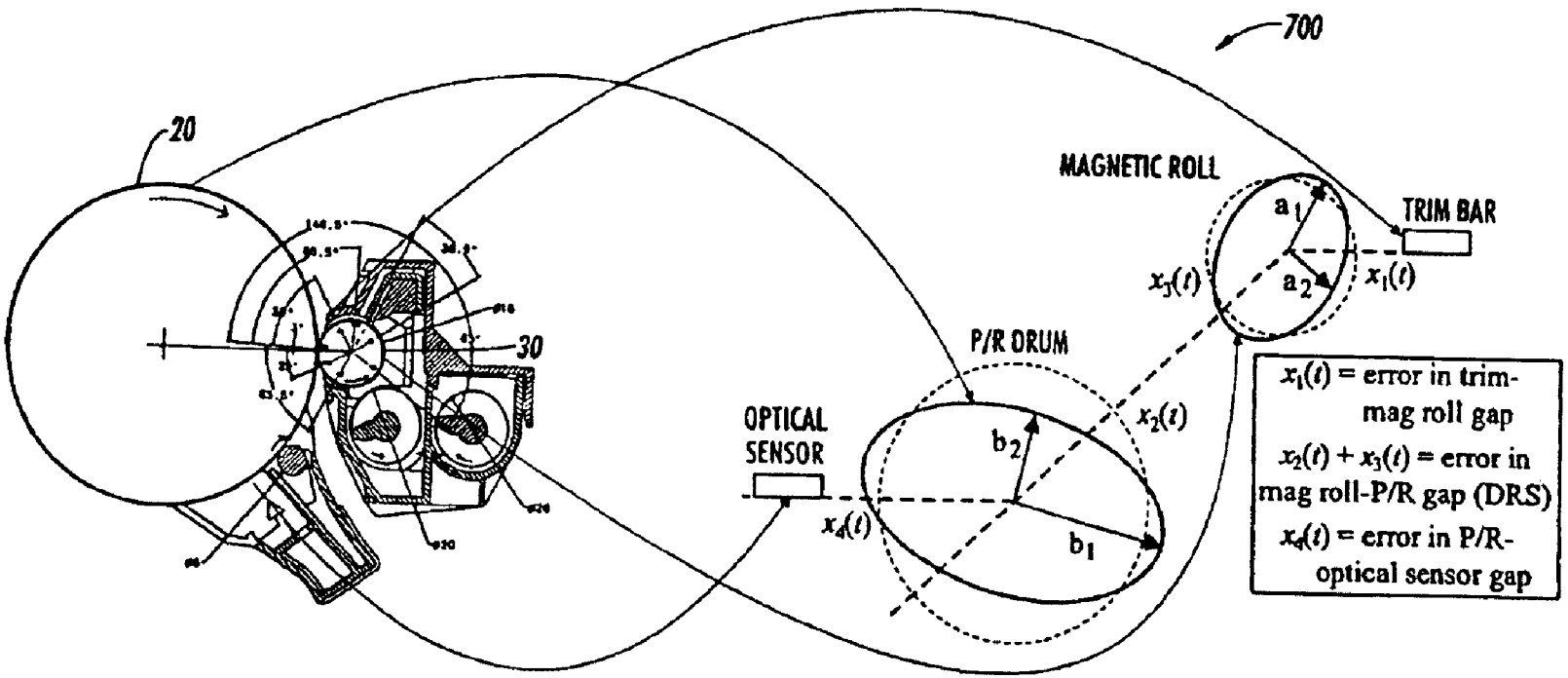
FIG. 7 schematically illustrates an exemplary simplified runout model for the image marking device of FIG. 3 employing the feedback and/or feedforward control loop strategies for controlling banding defects.

To examine the Internal Model Principle based calibration strategy shown in FIG. 4, the inventors have constructed a simulation based on a magnetic roll-to-photoreceptor drum development system, where runout was present in both the magnetic roll and the photoreceptor drum. FIG. 7 schematically illustrates an exemplary simplified runout model 700 for the image marking device 100 of FIG. 3 employing the feedback and/or feedforward control loop strategies for controlling banding defects.

As shown in FIG. 7, the basic model geometry is adapted from an exemplary image marking device schematic, as shown in FIG. 3. In this setup, runout is modeled using elliptical cross-sections for both the magnetic roll 30 and the photoreceptor drum 20. Other 3-dimensional forms of runout such as "bowing" runout or "conical" runout were not considered.

Figure 8:
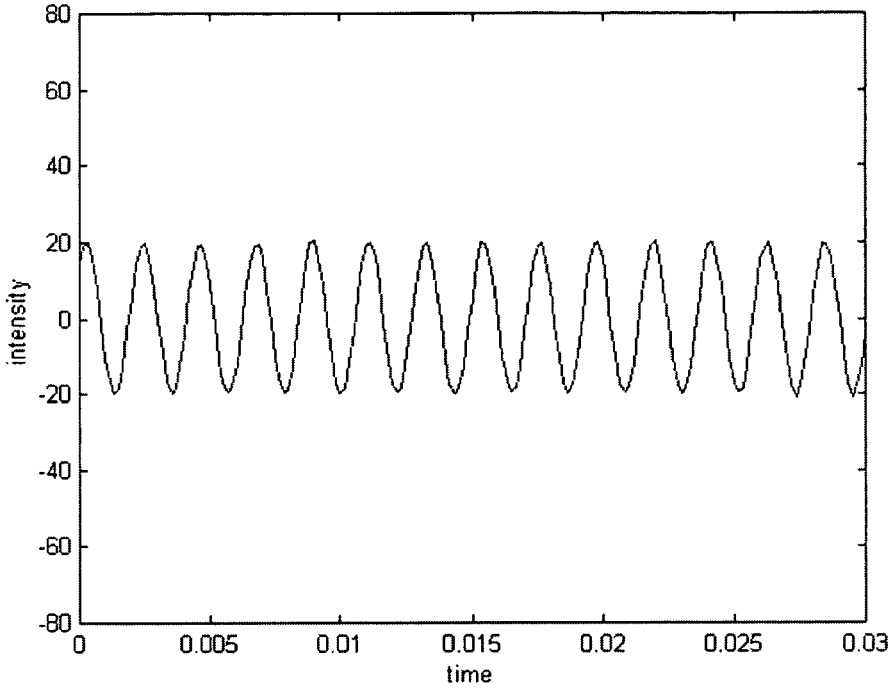
FIG. 8 illustrates a simulated optical sensor response for the case where the development voltage has not been calibrated for runout.
Figure 9:
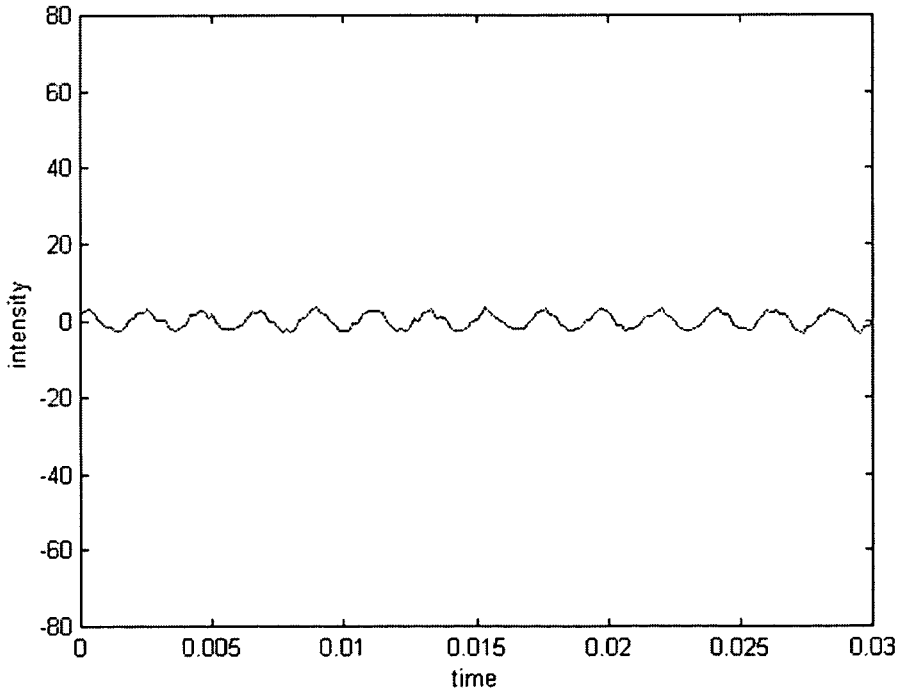
FIG. 9 illustrates a simulated optical sensor response for the case where the development voltage has been calibrated for runout according the exemplary feedback and/or feedforward control methods and systems of this invention.
Figure 10:
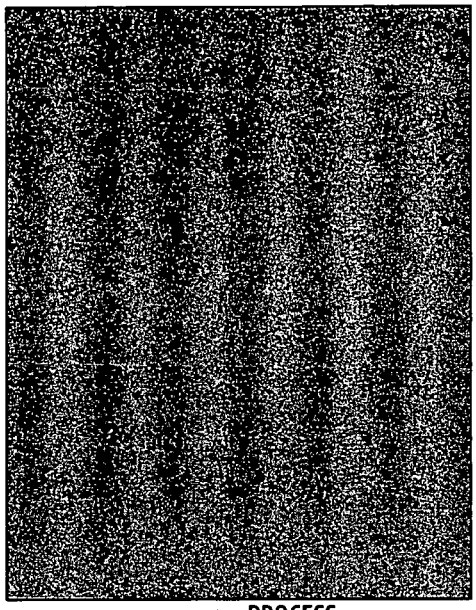
FIG. 10 illustrates a typical print corresponding to the case where the development voltage has not been calibrated for runout.
Figure 11:
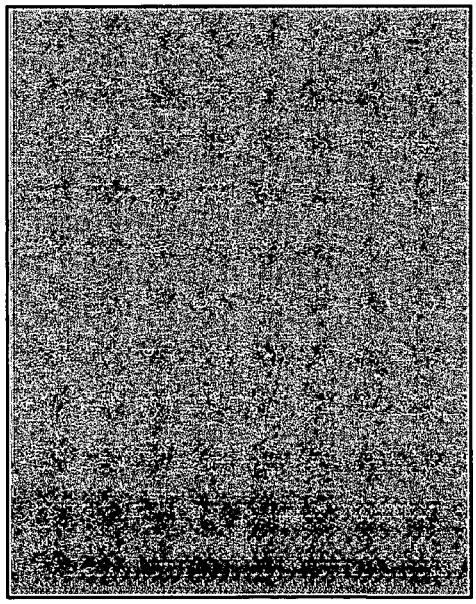
FIG. 11 illustrates a simulated print corresponding to the case where the development voltage has been calibrated for runout according the exemplary feedback and/or feedforward control methods and systems of this invention.

A simulated sensor measurement of a developed image on the photoreceptor drum is shown in FIG. 8 for the case where the level of runout is extreme and the development field has not been calibrated. An example of a print that could result from this level of density variation is shown in FIG. 10. For this print, $\Delta E_{peak\text{-}to\text{-}peak}$ is approximately 15. After a first-cut attempt at calibrating the development field voltage ($V_{dev}$) according to the Internal Model Principle approach described above, the sensor measurement of the developed image is as shown in FIG. 9. FIG. 11 illustrates a simulated print corresponding to the case where the development voltage has been calibrated for runout according the exemplary feedback and/or feedforward control methods and systems of this invention.

As indicated in FIGS. 8 and 9, the peak-to-peak variation in the sensor output has been reduced by more than a factor of 10 after the development field is calibrated. In addition, the sensor response after calibration implies $\Delta E_{peak\text{-}to\text{-}peak}$ is approximately 1. Given further refinements to the approach, the inventors anticipate reducing $\Delta E_{peak\text{-}to\text{-}peak}$ to less than 0.5, which is known to those skilled in the art as the perceptibility threshold for this banding frequency (0.03 cycles/mm).

Figure 12:
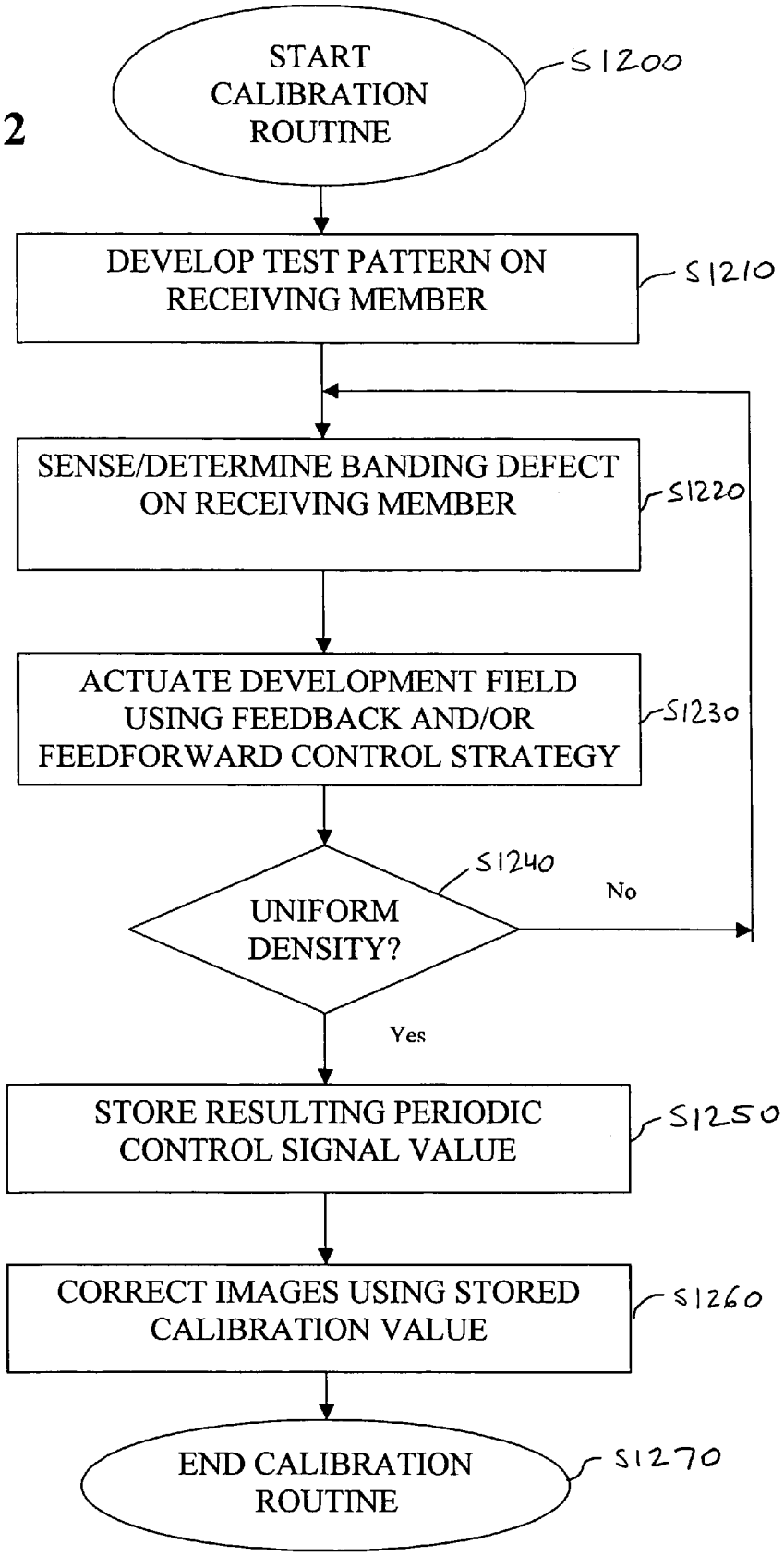
FIG. 12 is a flowchart of an exemplary embodiment of a method of controlling banding defects using a closed loop feedback and/or feedforward control strategy.

FIG. 12 is a flowchart of an exemplary embodiment of a method of controlling banding defects using a closed loop feedback and/or feedforward control strategy. Calibration could occur during machine cycle-up. In various exemplary embodiments, the method begins at step S1200, where the calibration routine is started, and continues to step S1210 where a given patch structure or test pattern is developed on a receiving member. The operation continues to step S1220 where a banding defect is sensed on the receiving member, e.g. photoreceptor, using an optical sensor, e.g. ETAC, and its extent determined.

Next, at step S1230, based on the extent of the banding sensed and determined, the development field is actuated using a feedback and/or feedforward control strategy, such as, for example, the repetitive control or adaptive feedforward control strategies discussed above. At step S1240, it is determined whether a uniform density has been achieved in the developed image. If it is determined that a uniform density has not been achieved, the operation returns to step S1220, where the operations of steps S1220 and S1230 are performed to determine and correct for the banding defects sensed on the receiving member.

If however, at step S1240, it is determined that a uniform density has been achieved in the developed image, operation continues to step S1250, where the resulting periodic control signal is stored as a function of developer roll position using, for example, an encoder. During routine machine operation, at step S1260, controlling and/or mitigating banding defects in images can be achieved by "playing back" the calibrated development field according to the developer roll position. The calibration routine continues to step S1270 where the calibration method ends.

Figure 13:
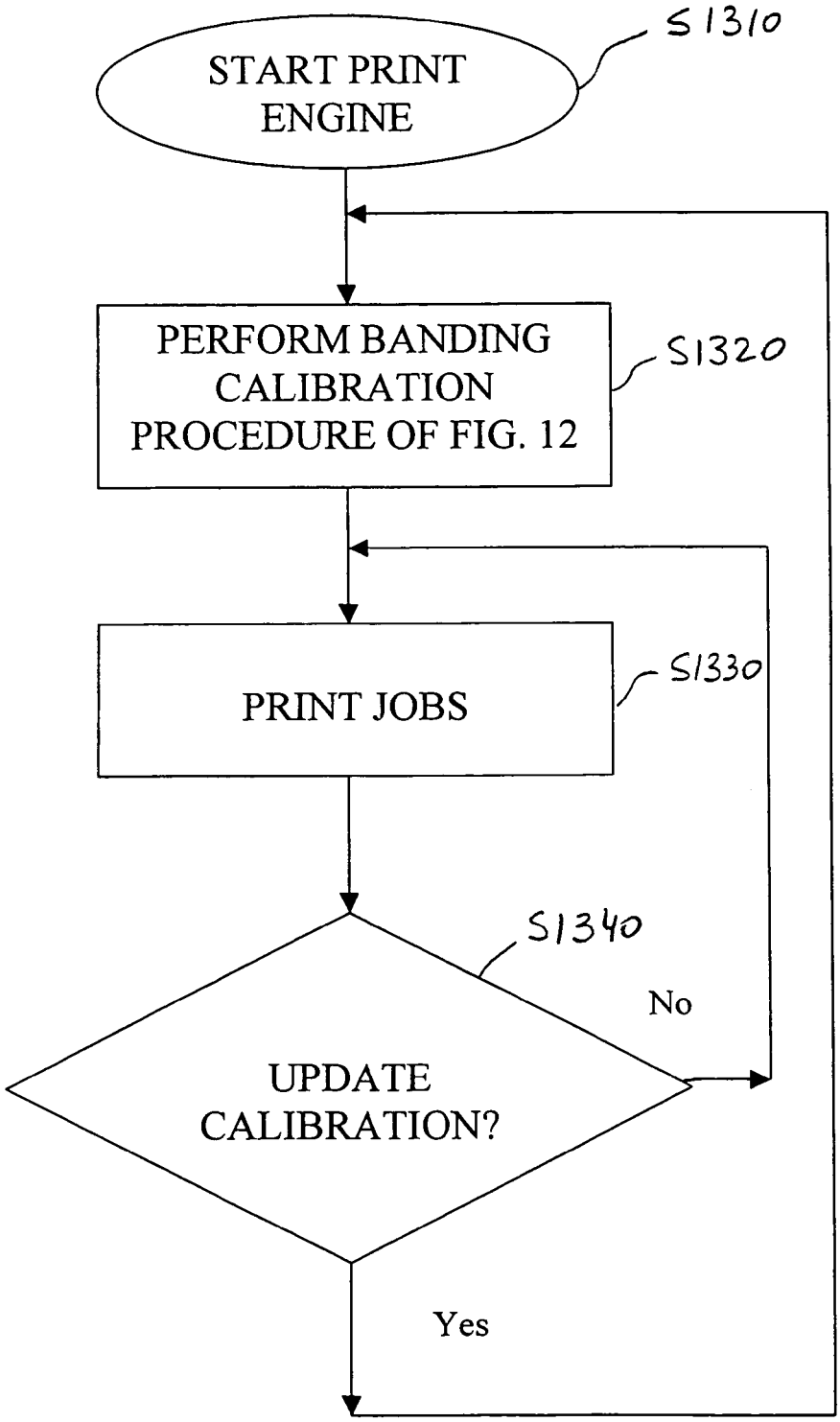
FIG. 13 is a flowchart of an exemplary embodiment of a method of updating the calibration of the development field of a print engine to control banding defects using a closed loop feedback and/or feedforward control strategy.

FIG. 13 is a flowchart of an exemplary embodiment of a method of updating the calibration of the development field of a print engine to control banding defects using a closed loop feedback and/or feedforward control strategy. As shown in FIG. 13, the method starts at step S1310 with operation of the print engine. As discussed above, calibration could occur during print engine cycle-up, although it is not limited to such timing or operational characteristics. Next, at step S1320, the print engine undergoes the banding calibration procedure or routine shown in FIG. 12. At step S1330, one or more print job operations are performed to determine whether unacceptable banding defects exist in the printed output. At step S1340, based on the extent of the banding defects determined and/or the cause of the banding determined, a determination is made whether the calibration routine needs to be updated to compensate and/or mitigate for the banding defects determined. If yes, the operation returns to step S1320 to perform the banding calibration procedure of FIG. 12. If not, the operation returns to step S1330 where the print job operations commence and/or continue.

In various exemplary embodiments of the systems and methods according to this invention, using a closed-loop feedback and/or feedforward control approach allows the use of components with relaxed tolerances, which would reduce unit machine cost (UMC). Furthermore, using a feedback and/or feedforward control approach would allow controller design to be easily scaled from one product to the next. Moreover, feedback and/or feedforward control is inherently robust to subsystem variations, such as developer material variations.

The feedback and/or feedforward control calibration approaches discussed above may enable print engines capable of high print quality that use developer rolls with relaxed tolerances. Achieving this goal, would lower UMC and improve print quality. In terms of UMC, the cost of this feedback and/or feedforward control approach may typically involve the cost of an optical sensor (e.g. ETAC) and a position sensor for the magnetic roll. However, optical sensors are currently used to measure developed density on the photoreceptor in many existing print engines.

Moreover, if the motor controlling the magnetic roll is servo controlled, then the encoder signal for this servo could be used to determine the roll position. Consequently, the cost of this approach could be minimal. Another advantage of the approach is scalability. For instance, speeding up a product would simply require calibrating the controller. Redesign of the architecture is not necessary. Finally, the closed loop feedback and/or feedforward control strategies discussed above could be used to mitigate banding from other sources besides runout due to developer roll or the photoreceptor drum, including for example, banding caused by coating variations on either the developer rolls or the photoreceptor, non-uniform photoreceptor wear, non-uniform charging, and developer material variations.

While the invention has been described in conjunction with the exemplary embodiments, these embodiments should be viewed as illustrative, not limiting. Various modifications, substitutes, or the like are possible within the spirit and scope of the invention.

What is claimed is:

1. A method of controlling banding defects on a receiving member of an image marking device, comprising:

determining a toner density on the receiving member;

automatically determining an extent of banding on the receiving member by comparing the determined toner density to a reference toner density value; and automatically adjusting the toner density based on a result obtained from the comparison of the measured toner density to the reference toner density value, the result comprising a control signal for a certain position on a developer member, wherein automatically determining the extent of banding and automatically adjusting the toner density are performed using a feedback and/or feedforward control routine or application.

2. The method of claim 1, wherein the feedback and/or feedforward control routine or application is based at least on an Internal Model Principle technique or an Adaptive Feedforward Control technique.

3. The method of claim 1, wherein the toner density is determined using an optical sensor.

4. The method of claim 3, wherein the optical sensor comprises a single spot optical sensor or an array-type optical sensor.

5. The method of claim 3, wherein the feedback and/or feedforward control routine or application interpolates the toner density determined by the optical sensor to adjust a toner output.

6. The method of claim 1, wherein automatically adjusting the toner density is performed using an electromechanical actuator.

7. The method of claim 6, wherein the electromechanical actuator comprises a developer roll voltage.

8. The method of claim 1, wherein the receiving member is at least one of a photoreceptor, an intermediate belt or an image recording medium.

9. A feedback and/or feedforward control system for controlling banding defects on a receiving member in a xerographic marking device, comprising:

an optical sensor arranged on the receiving member, the optical sensor determining a toner density on the receiving member;

an electromechanical actuator disposed in correspondence with the receiving member in the xerographic marking device; and a controller, coupled to the optical sensor and the electromechanical actuator, that:

automatically determines an extent of the banding defects on the receiving member by comparing the determined toner density to a reference toner density value; and automatically adjusts the toner density, based on a result obtained from the comparison of the measured toner density to the reference toner density value, by actuating the electromechanical actuator, the result comprising a control signal for a certain position on a developer member.

10. The system of claim 9, wherein the optical sensor comprises a single spot optical sensor or an array-type optical sensor.

11. The system of claim 9, wherein the electromechanical actuator comprises a developer roll voltage.

12. The system of claim 9, wherein the receiving member is at least one a photoreceptor, an intermediate belt or an image recording medium.

13. The system of claim 10, wherein the controller automatically determines the extent of banding and automatically adjusts the toner density using a feedback and/or feedforward control routine or application.

14. The system of claim 13, wherein the feedback and/or feedforward control routine or application is based at least on an Internal Model Principle technique or an Adaptive Feedforward Control technique.

15. A method of determining banding defects on a receiving member of a xerographic marking device, comprising:

creating at least one test pattern;

imaging the at least one test pattern;

determining a signal obtained during imaging of the at least one test pattern by an optical sensor arranged proximate the receiving member;

determining a certain position on a developer roll corresponding to the signal obtained during imaging:

processing the signal obtained during imaging; and determining an amount of banding defect based on the processed signal and the certain position on a developer member.

16. The method of claim 15, wherein the optical sensor comprises a single spot optical sensor or an array-type optical sensor.

17. The method of claim 15, further comprising controlling the banding defect determined using a feedback and/or feedforward control routine or application.

18. The method of claim 17, wherein the feedback and/or feedforward control routine or application is based at least on an Internal Model Principle technique or an Adaptive Feedforward Control technique.

19. The method of claim 17, further comprising storing a value of a control signal determined to reduce the banding defect determined.

20. The method of claim 19, wherein the control signal comprises at least a developer roll voltage.

21. A machine-readable medium that provides instructions for controlling banding defect in a receiving member of a xerographic marking device, the instructions, when executed by a processor, cause the processor to perform operations comprising:

determining a toner density on the receiving member;

automatically determining an extent of banding on the receiving member by comparing the determined toner density to a reference toner density value; and automatically adjusting the toner density based on a result obtained from the comparison of the measured toner density to the reference toner density value, the result comprising a control signal for a certain position on a developer member, wherein automatically determining the extent of banding and automatically adjusting the toner density are performed using a feedback and/or feedforward control routine or application.

22. The machine-readable medium of claim 21, the feedback and/or feedforward control routine or application is based at least on an Internal Model Principle technique or an Adaptive Feedforward Control technique.

23. The machine-readable medium of claim 21, wherein the toner density is determined using an optical sensor.

24. The machine-readable medium of claim 23, wherein the optical sensor comprises a single spot optical sensor or an array-type optical sensor.

25. The machine-readable medium of claim 21, wherein automatically adjusting the toner density is performed using an electromechanical actuator.

26. The machine-readable medium of claim 25, wherein the electromechanical actuator comprises a developer roll voltage.

27. A method of updating a calibration routine to control banding defects on a receiving member of an image marking device, comprising:

starting an operation cycle of the image marking device;

performing a calibration procedure to control banding defects as determined by the method of claim 15 on the image marking device;

performing a printing operation to determine image quality;

determining, based on a comparison of a value of the image quality obtained from the printing operation with a predetermined image quality value, whether a calibration operation is required; and performing the calibration operation.

28. The method of claim 1, further comprising storing the results.

29. The method of claim 1, further comprising storing a plurality of results corresponding to a plurality of positions on the developer member.

* * * * *